US008956073B2

(12) United States Patent
Whiteley

(10) Patent No.: US 8,956,073 B2
(45) Date of Patent: Feb. 17, 2015

(54) TRENCH COVER

(75) Inventor: Christopher James Whiteley, Enstone (GB)

(73) Assignee: Oxford Plastic Systems Limited, Oxfordshire, Enstone (GB)

( * ) Notice: Subject to any disclaimer, the term of this patent is extended or adjusted under 35 U.S.C. 154(b) by 0 days.

(21) Appl. No.: 13/520,829

(22) PCT Filed: Jan. 7, 2011

(86) PCT No.: PCT/GB2011/000008
§ 371 (c)(1),
(2), (4) Date: Jan. 17, 2013

(87) PCT Pub. No.: WO2011/083310
PCT Pub. Date: Jul. 14, 2011

(65) Prior Publication Data

US 2013/0108363 A1 May 2, 2013

(30) Foreign Application Priority Data

Jan. 8, 2010 (GB) ..... 1000240.0
Jan. 6, 2011 (GB) ..... 1100155.9

(51) Int. Cl.
*E02D 29/14* (2006.01)
*E02D 17/10* (2006.01)
*C23F 13/02* (2006.01)

(52) U.S. Cl.
CPC ..... *E02D 17/10* (2013.01); *C23F 13/02* (2013.01)
USPC ..... 404/25

(58) Field of Classification Search
USPC ..... 404/35, 36, 25; 14/69.5, 71.1
See application file for complete search history.

(56) References Cited

U.S. PATENT DOCUMENTS

| | | | | | |
|---|---|---|---|---|---|
| 686,490 | A | * | 11/1901 | Uphoff | 14/69.5 |
| 1,100,170 | A | * | 6/1914 | Brosius | 411/457 |
| 1,137,645 | A | * | 4/1915 | McCormick | 14/69.5 |
| 1,144,836 | A | * | 6/1915 | Green | 14/69.5 |
| 2,284,022 | A | * | 5/1942 | Schmeller, Sr. | 14/69.5 |
| 2,329,855 | A | * | 9/1943 | Rydner | 14/69.5 |
| 2,337,138 | A | * | 12/1943 | Berg | 14/69.5 |
| 2,452,222 | A | * | 10/1948 | Bryson | 14/69.5 |
| 2,452,289 | A | * | 10/1948 | Bryson | 14/69.5 |
| 2,461,678 | A | * | 2/1949 | Christensen | 14/69.5 |
| 2,521,349 | A | * | 9/1950 | Diamond | 14/69.5 |
| 2,637,978 | A | * | 5/1953 | Evans et al. | 166/358 |

(Continued)

FOREIGN PATENT DOCUMENTS

| | | |
|---|---|---|
| GB | 2405895 | 3/2005 |
| GB | 2436844 | 10/2007 |

(Continued)

OTHER PUBLICATIONS

International Search Report mailed May 25, 2011.

(Continued)

*Primary Examiner* — Abigail A Risic
(74) *Attorney, Agent, or Firm* — Andrus Intellectual Property Law, LLP

(57) ABSTRACT

A trench cover comprising a main body arranged to cover or partially cover a trench, in use, and retainer means operable to resist lateral movement of the cover, in use, the retainer means comprising a plurality of movable retainers, each being movable between a retracted position in which it projects beneath a lower surface of the main body.

2 Claims, 3 Drawing Sheets

(56) References Cited

U.S. PATENT DOCUMENTS

| | | | | | |
|---|---|---|---|---|---|
| 2,659,914 | A | * | 11/1953 | Law | 14/69.5 |
| 2,666,936 | A | * | 1/1954 | Palmer | 14/69.5 |
| 2,842,787 | A | * | 7/1958 | Murray et al. | 14/69.5 |
| 3,161,153 | A | * | 12/1964 | Johnson | 105/458 |
| 3,192,546 | A | * | 7/1965 | Noland | 14/69.5 |
| 3,238,548 | A | * | 3/1966 | Christensen | 14/69.5 |
| 3,491,394 | A | * | 1/1970 | Le Clear | 14/69.5 |
| 3,553,757 | A | * | 1/1971 | Noland | 14/69.5 |
| 3,881,206 | A | * | 5/1975 | Christensen | 14/69.5 |
| 4,480,944 | A | * | 11/1984 | Phares | 405/223 |
| 2001/0003886 | A1 | | 6/2001 | Mihalicz | |
| 2008/0075532 | A1 | | 3/2008 | Boyd | |
| 2009/0169298 | A1 | | 7/2009 | Lane | |

FOREIGN PATENT DOCUMENTS

| | | |
|---|---|---|
| GB | 2438059 | 11/2007 |
| GB | 2 456 341 | 7/2009 |
| WO | 2010021199 | 2/2010 |

OTHER PUBLICATIONS

Search Report for GB1100155.9 dated Jan. 27, 2011.

* cited by examiner

Figure 3a
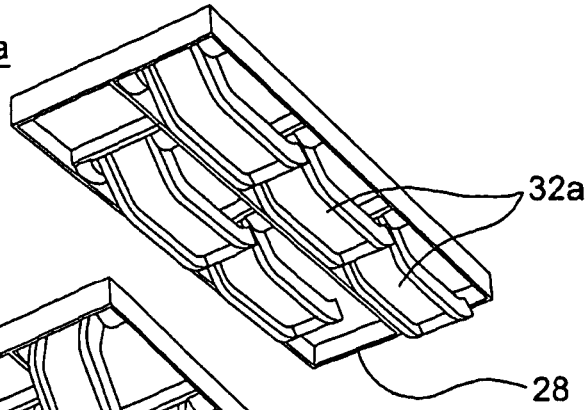
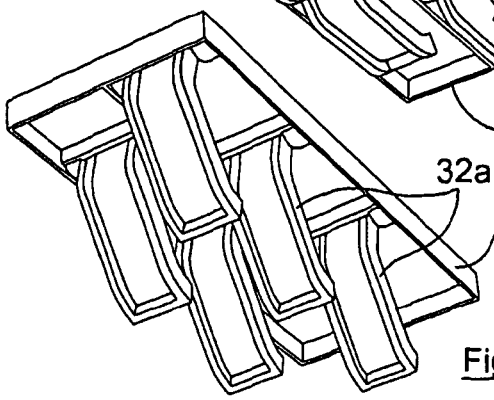
Figure 3b
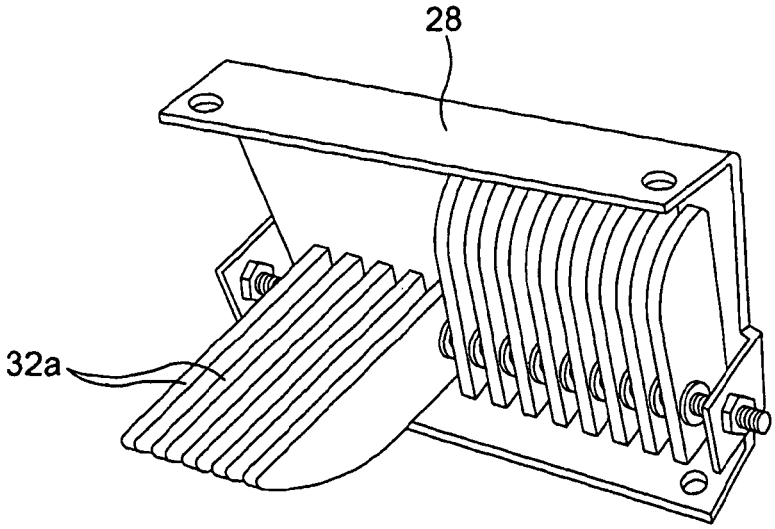
Figure 4

TRENCH COVER

CROSS REFERENCE TO RELATED APPLICATION

The present application is the U.S. national stage application of International Application PCT/GB2011/000008, filed Jan. 7, 2011, which international application was published on Jul. 14, 2011 as International Publication WO 2011/083310. The International Application claims priority of British Patent Application Nos. 1000240.0 filed Jan. 8, 2010 and 1100155.9 filed Jan. 6, 2011, the contents of which are incorporated herein by reference in their entireties.

This invention relates to a trench cover for use in covering trenches, manholes or other excavations, to allow the passage of pedestrians and/or vehicles over the trench or the like.

Where trenches or other excavations are formed in footpath or road surfaces there is a need to protect against the risk of injury or damage resulting from individuals or vehicles falling into the trench. In some applications barriers or the like can be erected around the trench to provide a visible indication to passers by of the presence of the trench and to restrict access thereto, thereby reducing the risk of such injury or damage. However, where continued use of the footpath or road surface is required when work is not ongoing, such arrangements are unsuitable. Instead, it is known to provide a cover over the trench, the cover being designed to bear the weight of, for example, an individual or a vehicle so as to allow continued use of the footpath or road surface. For example, steel sheets of a suitable thickness may be positioned over the trench. Alternatively, a range of moulded plastics trench covers may be used.

It has been found that, where trench covers are used, it is necessary to anchor the covers in position as individuals or vehicles passing over the covers will tend to dislodge and move the covers, and there is a risk that a cover, once moved, may be unstable or unable to safely bear the required load, and this could lead to injury or damage. One technique for anchoring trench covers in position involves using pins or spikes to pin the cover to the underlying surface. However, this may damage the surface, particularly if the cover has to be lifted on numerous occasions to allow access to the trench. A number of other techniques are known, but each involves a separate anchoring procedure to be completed before or after positioning the cover, and there is a risk that the procedure may be omitted leaving the cover unanchored.

It is an object of the invention to provide a trench cover incorporating a retainer to anchor the cover against movement, and which is of simple and convenient form.

According to the present invention there is provided a trench cover comprising a main body arranged to cover or partially cover a trench, in use, and retainer means operable to resist lateral movement of the cover, in use, the retainer means comprising a plurality of movable retainers, each being movable between a retracted position and an extended position in which it projects beneath a lower surface of the main body.

Conveniently, the retainer means includes a housing having a plurality of openings provided therein, the retainers comprising pins, each pin being associated with a respective opening, and each pin being held captive to the housing.

In use, with the main body positioned over a trench, the pins located over the trench will move to their extended positions under the action of gravity, whilst those positioned over the ground surface will occupy their retracted positions. The pins in the extended positions will serve to limit lateral movement of the trench cover by bearing against the side walls of the trench. It will be appreciated that the movement of the pins occurs automatically upon positioning the trench cover, and so no additional anchoring step is required.

The housing is conveniently a separate body secured to the main body, but alternatively could be formed, at least in part, integrally with the main body.

As an alternative to providing translatable pins, pivotally mounted fingers may be provided, each being pivotable between the retracted and extended positions.

In either case, although the retainers maybe movable under the action of gravity, they could be spring biased towards their extended positions if desired.

The invention will further be described, by way of example, with reference to the accompanying drawings, in which:

FIGS. 3 to 5 are diagrams illustrating alternative embodiments.

Figure 1:
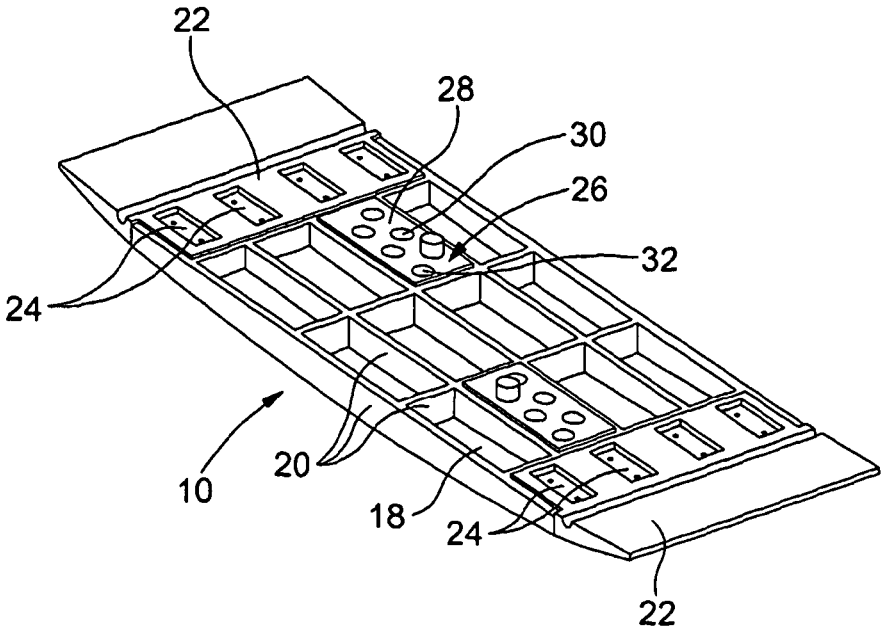
FIG. 1 is a perspective view illustrating the underside of a trench cover in accordance with an embodiment of the invention.
Figure 2:
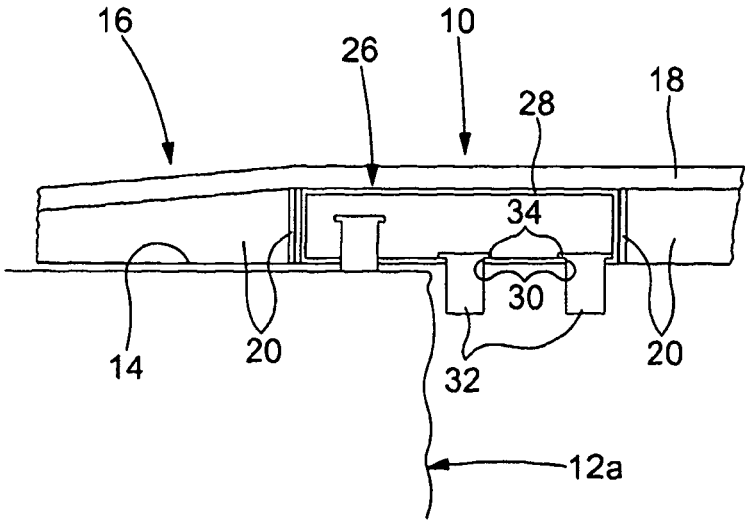
FIG. 2 is a diagram illustrating the trench cover of FIG. 1 in use.

The trench cover illustrated in FIGS. 1 and 2 of the accompanying drawings comprises a main body 10 of multi-part form which is adapted to extend, in use, across a cavity or trench 12 excavated in a road or footpath surface 14. So as to provide a temporary walkway or road surface over the trench 12. The main body 10 comprises a moulded plastics plate 16 having an upper part 18 of continuous form which is provided with a series of downwardly extending ribs 20. The ribs 20 extend both longitudinally of the main body 10 and laterally thereof.

The main body 10 further comprises a pair of end members 22 secured to the plate 16. The end members 22 are of flexible form, being manufactured from a rubberised plastics material. The flexibility of the end members 22 is of assistance in that it can accommodate irregularities in the surface 14. Further, the risk of damage to the trench cover in the event of impact thereto is reduced. Further, the rubberised material of the end parts 22 assists in reducing creeping movement of the trench cover relative to the ground surface 14. Another advantage is that noise created when vehicles pass over the cover is reduced by the end members 22. This is particularly the case where the end members 22 extend beneath the edges of the cover. Although not illustrated, the end parts 22 will be secured to the plate 16 by bolts passing through metal plates located within a series of recesses 24. However, it will be appreciated that other fixing techniques could be used if desired.

In accordance with the invention the trench cover is provided with retainer means 26 to further assist in resisting movement of the trench cover relative to the ground surface 14. Separate retainer means 26 are provided adjacent or towards each end of the part 16 to co-operate with opposing side surfaces 12*a* of the trench 12. Each retainer means 26 comprises a housing 28 having a lower wall in which a series of openings 30 are provided. Each opening 30 has a movable pin 32 associated therewith. Each pin 32 includes an enlarged diameter flange 34 at its upper end. The flanges 34 are of diameter greater than that of the openings 30 with the result that the pins 32 are held captive to the housing 28, each pin 32 being capable of movement between a retracted position in which the pin is located primarily within the housing 28 and an extended position in which a majority of the pin 32 projects through the associated opening 30 and thus is located outside of the housing 28. Each pin 32 is free to move between its extended and retracted positions under the action of gravity. If desired, springs could also be provided to assist in extending the pins 32.

It will be appreciated that when the trench cover 10 is held in its normal in use orientation, the action of gravity on the pins 32 will result in each pin 32 occupying its extended position. If, from this position, the trench cover is lowered into position above the trench 12, then those of the pins 32 located above the trench 12 will remain in their extended positions, projecting into the upper part of the trench 12, whilst the pins 32 positioned above the ground surface 14 in which the trench 12 has been excavated will bear against the ground surface 14 and the lowering of the trench cover into position will result in those pins 32 being pushed inwardly into the housing 28. It will thus be appreciated that the action of lowering the trench cover into position will automatically result in some of the pins 32 being extended whilst others of the pins will be retracted.

As shown in FIG. 2, when so positioned, the extended pins 32 closest to the side walls 12*a* of the trench 12 will serve to limit movement of the trench cover by engagement with the corresponding side walls 12*a*. As illustrated, the pin 32 closest to the side wall 12*a* is spaced slightly therefrom. However, movement of the trench cover the left in the orientation illustrated will be limited as, once this spacing has been taken up, the engagement between the pin 32 and the side wall 12 will prevent further movement in that direction. Similarly, although not shown, the retainer means 26 associated with the opposite end of the trench cover will serve to resist movement of the trench cover to the right in the orientation illustrated.

As the retainer means 26 functions automatically to resist lateral movement of the trench cover upon installation of the trench cover, no separate step of fitting or activating the retainer means being required, then it will be appreciated that the trench cover is of simple and convenient form for use. Further, the retainer means can be easily applied to covers of a wide range of widths or sizes.

In the arrangement illustrated, each housing 28 is a separate component securable in position between associated ones of the ribs 20, for example by the use of bolts or the like passing through the associated ribs 20 and into tapped openings formed in the housings 28. However, it will be appreciated that other techniques for securing the housings 28 in position may be used. Further, it may be possible for the housings 28 to be manufactured integrally, at least in part, with the main part 10.

In order to minimise corrosion, it is currently envisaged that the pins 32 will be of zinc plated mild steel form. However, other materials may be used.

Another embodiment is illustrated in FIGS. 3*a* and 3*b*. In that arrangement, the retainers comprise pivoting fingers 32*a* instead of pins 32, and finger 32*a* being pivotally connected to the housing 28 (or direct to the main part 10) so as to be pivotable between retracted and extended positions. FIG. 3*a* shows the fingers 32*a* in the retracted position and FIG. 3*b* shows them in the extended position. Operation is similar to that outlined hereinbefore.

FIG. 4 illustrates another embodiment which includes pivoting fingers 32*a*, showing some in the retracted position and some in the extended position. In this embodiment the fingers are mounted upon a comment pivot axis, separated conveniently by nylon washers or the like. The fingers could be stamped or moulded from a suitable plastics material or may be of steel plate form.

Figure 5:
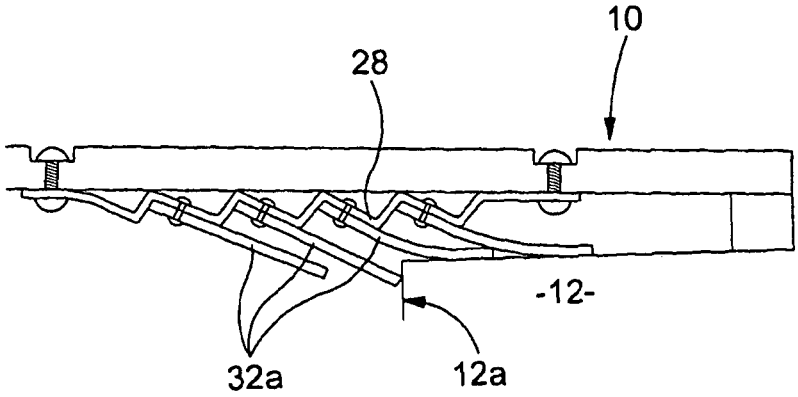

FIG. 5 illustrates a modification in which the fingers 32*a*, instead of being of pivotable form, or flexible and so can bend or flex between a retracted position and an extended position. The fingers of this design are conveniently formed by pultrusion, or of spring steel form, and are conveniently riveted or otherwise affixed to a suitably shaped, corrugated base plate.

It will be appreciated that a wide range of modifications or alterations may be made to the arrangement herein described before without departing from the scope of the invention. For example, retainer means 26 could be used in conjunction with a wide range of other forms of trench cover.

The invention claimed is:

1. A trench cover comprising a main body arranged to cover or partially cover a trench, in use, the main body being provided with downwardly depending longitudinally and laterally extending ribs defining rectangular recesses on the underside of the main body, and retainer means operable to resist lateral movement of the cover, in use, the retainer means comprising a plurality of movable retainers, each being movable between a retracted position and an extended position in which it projects beneath a lower surface of the main body, wherein the retainers include rectangular housings each having a surface that is coplanar with an end surface of the ribs, and a plurality of openings provided in the coplanar surface, the housings being secured within the main body in the recesses between and abutting adjacent ones of the ribs, the retainers comprising pins slidable within the housing, each pin being associated with a respective opening of the coplanar surface and freely slidable within the respective opening, and each pin being held captive to the housing.

2. A trench cover according to claim 1, wherein each movable retainer is arranged to be movable by the action of gravity between its retracted and extended positions.

* * * * *